United States Patent [19]

Hocevar

[11] Patent Number: 4,817,357

[45] Date of Patent: Apr. 4, 1989

[54] SUSPENSION CEILING GRID TEE

[75] Inventor: Joseph A. Hocevar, Willoughby Hills, Ohio

[73] Assignee: Donn Incorporated, Chicago, Ill.

[21] Appl. No.: 135,922

[22] Filed: Dec. 21, 1987

[51] Int. Cl.[4] ..... E04C 3/32

[52] U.S. Cl. ..... 52/732; 156/291; 156/307.3; 52/729; 52/232

[58] Field of Search ..... 156/307.3, 291; 52/732, 52/232, 484, 420, 729

[56] References Cited

U.S. PATENT DOCUMENTS

| | | | |
|---|---|---|---|
| 2,304,718 | 12/1942 | Swart | 156/307.3 |
| 3,730,798 | 5/1973 | Franz | 156/391 |
| 4,206,578 | 6/1980 | Mieyal | 52/484 |
| 4,554,718 | 11/1985 | Ollinger et al. | 52/732 |
| 4,713,919 | 11/1987 | Platt | 52/732 |

FOREIGN PATENT DOCUMENTS 742629 12/1955 United Kingdom .

*Primary Examiner*—James L. Ridgill, Jr.

*Attorney, Agent, or Firm*—Pearne, Gordon, McCoy & Granger

[57] ABSTRACT

A grid tee for suspension ceilings is disclosed which includes a metal strip bent to provide a stiffening bulb along one edge, a pair of parallel web portions extending from the bulb in face-to-face adjacency, and a flange portion extending laterally in opposite directions from the side of the web remote from the bulb. A second elongated piece of sheet metal forming a cap is positioned against the side of the flange remote from the bulb and is connected to the flange along the edges thereof by a reverse bend. A band of cross-link cured adhesive is located at the interface between the flange and the cap, bonding the two together. The adhesive effectively closes the section and provides torsional stiffness to the grid tee.

10 Claims, 1 Drawing Sheet

SUSPENSION CEILING GRID TEE

BACKGROUND OF THE INVENTION

This invention relates generally to grid tees for suspension ceilings and the like, and more particularly to a novel and improved grid tee in which increased torsional stiffness is provided by an adhesive bonding adjacent layers of the sheet metal forming the basic grid tee structure.

PRIOR ART

Grid tees for suspension ceilings often provide two elongated strips of thin sheet metal bent and joined to provide an inverted "T" structure. In such runners, one strip of metal is usually bent to provide a stiffening bulb along the upper extremity of the tee, from which a two-layer web depends. Opposed flanges extend from the sides of the web remote from the bulb. The other strip provides a cap positioned along the underside of the flanges and is secured to the outer edges thereof by a reverse bend. Such runners are assembled in grids defining openings, and the flanges support the edges of panels and fixtures.

In order to reduce material costs, there has been a trend to form grid tees of thinner and thinner sheet metal. In fact, in some instances, a structure has been provided in which the web material is very thin and additional material is concentrated at the extremities of the tees in the bulb and along the flanges so as to provide a structure which requires less material for a given load-carrying capacity. An example of such a grid tee is illustrated in U.S. Pat. No. 4,206,578 (assigned to the assignee of the present invention).

It has been found in some instances, however, that if very thin material is used to form the basic grid tee structure, the torsional stiffness of the grids deteriorates appreciably, and the grid tee is difficult to handle during assembly. Further, since actual failure of a grid tee usually involves twisting of the tee until failure occurs, the ultimate strength of the grid tee structure deteriorates as its torsional stiffness deteriorates.

The typical grid tee mentioned above does not provide a functionally "closed section." When such grid tees are subjected to a torsional force couple, tending to cause twisting of the tee, the connecting portions of the cap and the flange edges move longitudinally relative to each other, allowing such twisting movement. As a result, the two strips of metal forming the tee do not efficiently cooperate to produce the maximum torsional stiffness that could be obtainable in a "closed section" in which the cap and flanges are connected in a manner preventing such relative movement.

In U.S. Pat. No. 4,554,718, a grid tee structure is described in which a hot metal adhesive is provided to interconnect the cap and flanges or to interconnect the two layers of the web adjacent to the flanges in order to provide improved torsional stiffness. Although hot melt adhesive will improve torsional stiffness to some extent, such adhesive is relatively rubbery and does not provide a structure which approaches the full stiffness which can be obtainable. Further, because hot melt adhesives are thermoplastic, the adhesive tends to soften and lose its effectiveness at elevated temperatures, and tends to become brittle and to fracture at low temperatures.

Further, the British specification No. 742,629, published Dec. 30, 1955, discloses a grid tee in which the bulb is welded or the like to provide a closed section for torsional stiffness.

It is also believed that an epoxy adhesive has been employed in grid tees to bond adjacent metal surfaces of a two-layer web. Such structure resulted in very good torsional stiffness. However, because such adhesive tends to be very rigid and non-elastic, it tends to fracture and fail when subjected to torsional loads. It is believed that the producers of such grid abandoned production thereof because of such fracture-type failures.

SUMMARY OF THE INVENTION

The present invention provides an improved grid tee for suspension ceilings and the like in which an adhesive bonds adjacent layers of the metal grid structure to provide a "closed section" for improved torsional stiffness, and in which the adhesive bond is reliably maintained. Such adhesive is of a type which cross-links during cure and which is substantially insensitive to temperature changes. Further, the adhesive provides sufficient elasticity so that it does not fracture under torsion loading even when substantial twisting of the grid tee is encountered. The preferred adhesive is a solvent-free urethane adhesive having a shear strength of about 4000 psi. Tests on grid tees employing such adhesive established substantial torsional stiffness improvement and did not encounter fractures in the adhesive even when the grid tee was twisted through a sufficient angle to cause yield in the metal forming the grid tee, resulting in a permanent twist within the grid tee.

In accordance with another aspect of this invention, a grid tee is adhesively bonded with an adhesive which does not cure for a substantial period of time. Therefore, it is satisfactory for use in production systems in which the grid must be twisted during its manufacture through significant angles after the adhesive is applied or otherwise manipulated before the production of the grid tee is completed. In accordance with this aspect of the invention, the adhesive remains substantially uncured for a period of time sufficient to allow the completion of the manufacture of the grid tee, and preferably until the grid tee is packaged for storage and shipment in a straight condition. Consequently, the finished tee, because the adhesive cures while the tee is held stationary in a straight condition, provides a straight tee having good torsional stiffness.

In the illustrated embodiment, adhesive is applied and provides a bond between the cap and the flanges at a location spaced from the web. By providing the adhesive bond at such location, the closed section provided by the adhesive has its maximum size and a maximum amount of structural integrity is provided between the cap and the grid tee body. Therefore, the torsional stiffness of the grid tee is maximized, and improvements in both load-carrying capacity and ultimate strength of the grid tee are achieved.

These and other aspects of this invention are illustrated in the accompanying drawings, and are more fully described in the following specification.

DETAILED DESCRIPTION OF THE DRAWINGS

Figure 1:
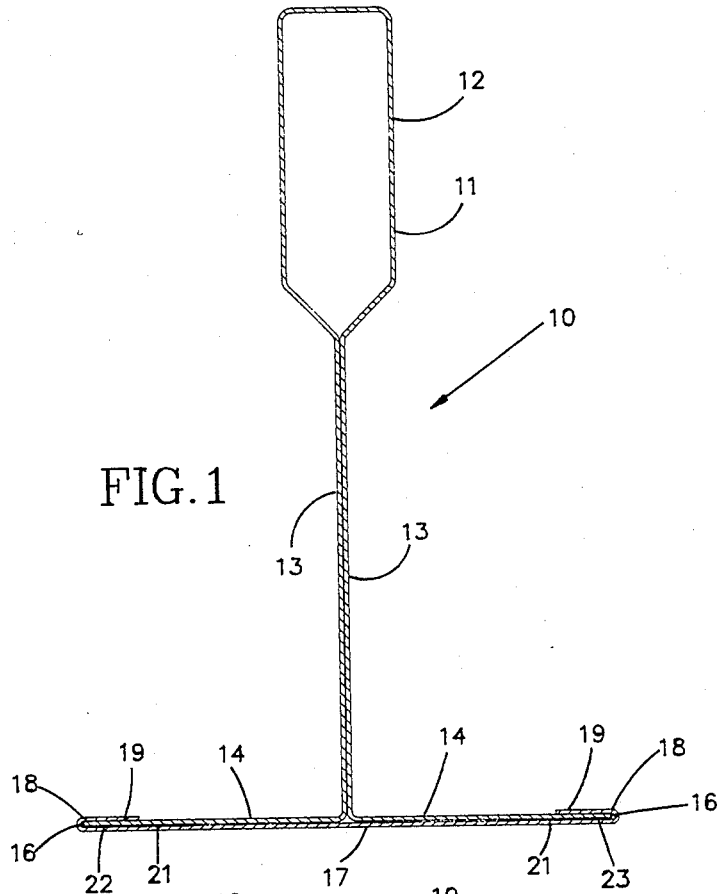
FIG. 1 is a cross section of a typical grid tee incorporating one preferred embodiment of this invention.

FIG. 1 illustrates a typical grid tee 10 of the type often used in suspension ceilings and the like, to which the present invention is particularly suited. Such grid tee is usually installed in a grid consisting of main runs and cross-runs, or in grids of the basket-weave type. In either type of grid, end connectors are provided to interconnect the grid tees at intersections when the tees are assembled in a grid. In a typical installation, the grid tees cooperate to define rectangular or square openings bounded by flanges on which ceiling panels or fixtures are supported. It should be understood that the present invention is applicable to various types of grid tees, and the particular grid tee illustrated in the drawings is given as an example of one general type of grid tee to which the present invention is applicable.

The illustrated grid tee 10 is formed of two strips of thin sheet metal. The body strip 11 is bent to provide a hollow bulblike structure 12 at the upper extremity of the grid and a pair of depending web portions 13 extending from the bulb in face-to-face adjacency. At the lower edge of the web the body strip is bent to form a pair of oppositely extending flange portions 14 on which the panels, tiles or fixtures are supported. Such flanges extend to outer edges 16.

The second strip or cap 17 is positioned along the lower side of the flange portions 14 and is connected to the body strip 11 by opposed hems 18 each providing a reverse bend so that a portion 19 of the cap 17 extends along the upper surface of each flange portion 14 to mechanically interconnect the cap and the body 11. The structure thus far described is a conventional grid tee, and is provided with end connectors (not illustrated). A suitable end connector is illustrated in U.S. Pat. No. 4,108,563, granted Aug. 22, 1978, and assigned to the assignee of the present invention. Such patent is incorporated herein by reference to illustrate one typical kind of end connector which may be used at the ends of the grid tee 10.

The structure thus far described does not provide a closed section in that the mechanical connection provided by the hem 18 does not prevent relative longitudinal movement between the edges 16 of the flanges 14 and the associated hems 18. Consequently, when rotational force couple or moment is applied to the tee, a longitudinal twisting occurs, and relative longitudinal movement takes place between the adjacent parts of the body 11 and the cap 17. Although the mechanical interconnection provided by the hem does, to some limited extent, resist such longitudinal movement, and therefore provide a degree of torsional stiffness to the structure, it does not reliably provide an effectively closed structure. In reality, the body 11 and cap 17 function substantially separately to resist twisting movement, and torsional stiffness is determined primarily by the physical properties and thickness of the individual elements of the combined structure. In effect, an "open section" is provided.

In accordance with the present invention, an adhesive 21 is positioned between adjacent layers of the structure to produce a "closed section" in which significant relative longitudinal movement is prevented between adjacent layers of the structure.

Figure 2:
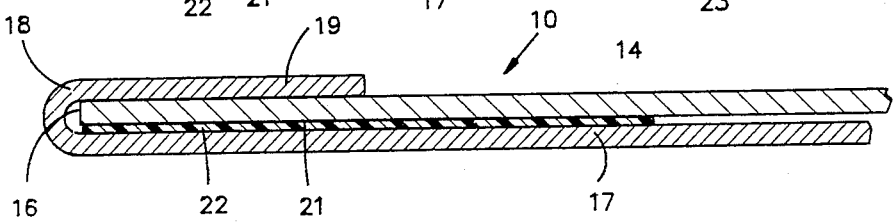
FIG. 2 is an enlarged, fragmentary section, illustrating one of the bonded connections between the two strips of metal forming the body and cap of the grid tee.

In accordance with the preferred embodiment illustrated, the adhesive 21 is applied in two similar bands 22 and 23 along the interface between the flange portions 14 and the cap 17, preferably substantially along the outer portions of the flange portions 14, as best illustrated in FIG. 2. In FIG. 2, only the band 22 is illustrated, but it should be understood that a similar and opposite band 23 is provided at the other extremity of the grid tee flange.

The bands 22 and 23 provide a bond connecting the adjacent portions of the body 11 and cap 17, and prevent any substantial relative movement therebetween. Consequently, relative longitudinal movement between the flange portions and the cap is virtually eliminated and a closed section is provided. This results in substantially improved torsional stiffness to the total structure.

As illustrated, it is preferred to locate the bond of adhesive substantially adjacent to the outer edges of the cap 17 and flange portions 14. Such location of the bond produces the maximum torsional stiffness for a given structure because the body 11 and cap 17 cooperate to the maximum extent possible to resist twisting of the grid. It is, however, within the broader aspects of this invention to provide a bonding connection between the cap and the flange portions spaced from the flange edges 16.

In establishing a commercially acceptable adhesive for use in accordance with this invention, it has been established that the following parameters are important with respect to the properties of the adhesive. The adhesive preferably should (1) not run or drip, or otherwise leave the application area of the part, regardless of the part's orientation;
(2) be effective when applied in a thin layer having a thickness in the order of 0.001 inch to 0.006 inch;
(3) not be destroyed when the section is twisted an amount which can be achieved by hand rotation when the section is handled prior to installation;
(4) have enough stiffness to effectively make the section "close" without developing any tendency to be brittle;
(5) not degrade under any probable storage or transport condition within temperature ranges from about 175° F. and −40° F. even at 100% relative humidity;
(6) be resilient enough, even if the adhesive cures while the grid is in a mildly twisted state, so that installed end connectors are sufficiently strong to straighten the tee;
(7) be able to resist any impact fracture;
(8) be unable to emit excessive quantities of toxic contamination when exposed to fire;
(9) be capable of maintaining a good bond even when the grid is rotated or twisted an amount causing the metal of the tee to yield;
(10) be able to maintain bond strength at all normal temperatures expected to be encountered by the grid in use;
(11) be able to provide good adhesion in the presence of lubricant used during the forming of the grid, so as to eliminate any necessity of cleaning of the parts;
(12) not require elevated temperatures of the body 11 or the cap 17 for its application or cure;
(13) be capable of being applied at relatively high line speed normally used in the rolling process in which the grid tee is formed; and
(14) be relatively low in cost.

Figure 3:
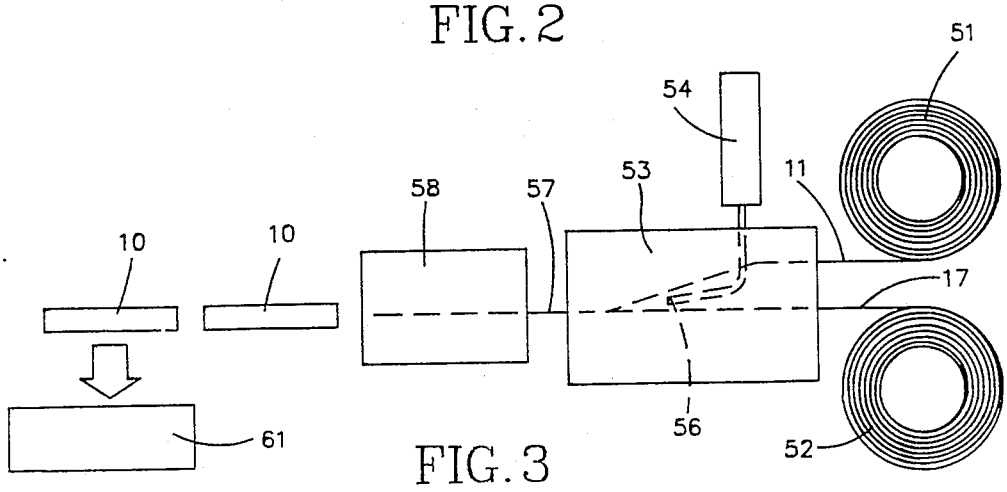
FIG. 3 is a schematic illustration of the apparatus and method of producing grid tees in accordance with this invention.

Generally, grid tees for suspension ceilings of the type involved here are formed by rolling mills which are supplied with large coils of strip material and which operate to produce the grid tees either on a continuous basis or in long interrupted lengths. FIG. 3 schematically illustrates a typical method and apparatus for producing grid tees. The body strip 11 material is supplied from a first coil 51 and the cap 17 material is supplied from a second coil 52. The body strip 11 and cap 17 strip enter a rolling mill 53 which shapes and joins the strip to produce the final cross section of the grid. The adhesive, which is heated in one preferred embodiment, is applied from a source 54 through nozzles 56 as round beads just before the cap 17 is assembled on the body 11. A long or continuous length of grid tee 57 passes from the rolling mill 53 to a shear 58 which cuts the grid tees into lengths 10 suitable for assembly in a suspension ceiling grid system.

If the end connectors are integrally formed, they are formed during the shearing operation. If separate end connectors are used, they are attached to the lengths 10 to complete the fabrication of the grid tees. Thereafter, a plurality of grid tees 10 are usually packaged in packages 61 for storage and shipment. In such packages, the grid tees are maintained in a straight condition.

During the manufacture of the grid tees, the processing operations often require twisting or other manipulation of the tee after it is substantially fully assembled. Therefore, it is preferable to provide an adhesive which cures over a sufficient period of time so that most of the curing of the adhesive occurs after the completed grid is formed and after it is packaged and held in such package in a straight condition. Such adhesive, therefore, does not cure to any appreciable extent during the manufacturing operation itself, and is not damaged by manipulation of the grid tee required during the manufacture. Further, the possibility of the grid tee being cured while in a non-straight condition is avoided.

Additionally, the adhesive should be of a type which becomes substantially solidified prior to the cutting of the grid tees to length so that the adhesive material does not gum up the shear used for cutting the grid into lengths.

One preferred adhesive which has been found to be very satisfactory for use in accordance with the present invention is a solvent-free, one-part moisture curing urethane adhesive manufactured by Bostik Corporation, of MIddleton, Mass., and designated by such company as "Super Grip 9706." At room temperatures prior to cure, such adhesive is a hard waxlike substance which softens with heat so that it can be applied as a bead along either the cap or the flange portion immediately prior to the assembly of the cap 17 onto the flange portions 14. Preferably, each bead is about 0.022 inch in diameter when initially applied. However, when the cap and the flanges are brought together and hemmed, the bead immediately flattens to a thickness less than 0.006 inch, and preferably about 0.003 inch, and a width of about ⅛ to ¼ inch. Therefore, a relatively large bonding area is provided along each of the bands of adhesive 22.

Since it is customary to apply substantial pressure between the flange portions 14 and the cap 17 during the hem forming operations within a rolling mill, sufficient force is already present in the processing operation to cause the essentially circular bead to be flattened to a very thin layer of adhesive. Further, the operation of applying the cap to the flange portions occurs sufficiently close to the point at which the bead of adhesive is applied so that the bead remains at its softened elevated temperature and squeezes down to a thin band without difficulty. However, because the band is quite thin, and because the cap 17 and flange portions 14 are essentially at ambient temperature, the adhesive almost immediately returns to its solid, uncured state, and subsequent shearing operations do not result in a gumming up or clogging of the shear components.

Further, since adhesive is a one-part adhesive, it is not necessary to apply two coatings or to premix the adhesive before it is applied to the grid. Such adhesive tends to completely cure over a period of about twenty-four hours, with the cure being caused by moisture in the environment. Such adhesive is preferred for use in rolling operations which do not employ lubricants and are performed dry, or in rolling operations in which a water-base lubricant is used during the formation of the grid tees. Such water-base lubricants do not adversely affect to any material extent the adhesive bond obtained when the adhesive cures.

Because the adhesive bands 22 and 23 are very thin, the adhesive prevents any substantial movement between the adjacent metal surfaces and an effective closed section is provided. This is true even though the adhesive remains elastic. Since the adhesive remains elastic to some extent and does not become brittle during the cross-linking during its cure, the finished grid can be twisted through substantial angles without failure. In fact, four-foot lengths of grid tees incorporating the preferred urethane adhesive can be twisted from end to end through as much as 180 degrees without bond failure. Further, in tests performed on grid tees incorporating the present invention, it was possible to twist the grid through even greater angles to cause yielding of the metal itself and produce permanent set in the metal without destroying the adhesive bond. Such grid, however, would be unsatisfactory for use because of the yield having occurred in the metal of the grid tee itself.

In one comparative test, a grid tee, which in the absence of adhesive had very little torsional stiffness, exhibited relatively high torsional stiffness when the above-mentioned solvent-free urethane adhesive was utilized. Such a four-foot long grid tee, in the absence of adhesive, could be rotated through 90 degrees between its ends, or about 2 degrees per inch of length, with a torque of about 0.8 inch/pounds. However, a similar piece of grid in which a solvent-free urethane adhesive mentioned above was applied as illustrated required about 10 inch/pounds to cause 90 degrees of rotation in the four-foot lengths.

Experience has demonstrated that the torsional stiffness, to be commercially acceptable, should require at least about 3 inch-pounds, and preferably about 5 inch-pounds, to rotate a four-foot length through 90 degrees between its ends. Therefore, it is apparent that with the present invention, the torsional stiffness provided amply meets and substantially exceeds the torsional stiffness requirements for a satisfactory commercial grid, even when it is applied to a grid section having very low inherent torsional stiffness.

In some instances, a rolling process for forming grid tees may employ an oil-base lubricant. In such instances, it is desirable to utilize an adhesive in which the bond does not significantly degrade in the presence of oil. In such cases, it is preferred that an adhesive may be used consisting of a methacrylate and an aldehyde catalyst.

One such adhesive is designated as Devcon MVP-33, manufactured by Devcon Company, of Danvers, Mass. This system is a 100% solid binder that has similar structural properties to the solvent-free urethane adhesive described above, including high shear strength, good elasticity, and ease of workability. This adhesive is preferred for use in instances in which an oil-base lubricant is used in the rolling process, since it is capable of establishing a good bond strength even in the presence of a film of oil on the parts to be bonded. Here again, it is preferred to establish a cure rate so that the grid tee manufacture is completed and the grid tees are packaged and held straight in such package prior to the time substantial curing of the adhesive occurs.

The beads of adhesive which are applied should be small, and should be spread into very thin bands for several reasons. First, very thin bands of adhesive 22 and 23 having a thickness less than about 0.006 inch, and preferably a thickness of about 0.003 inch, provide a connection between the adjacent metal layers that prevents any substantial relative movement even though the adhesive is elastic. Therefore, high torsional stiffness is provided. Second, thin bands require less adhesive, so costs are minimized. Third, the small amount of adhesive minimizes toxic problems in the case of fire.

Comparative tests were also performed using epoxy adhesive. Such adhesive, which is substantially nonelastic, provided good torsional stiffness. However, when a four-foot length was twisted through 40 degrees, the adhesive fractured and the torsional stiffness was lost.

Although in accordance with the broader aspects of this invention the adhesive may be located at other locations, it is preferred that the adhesive bonds be located adjacent to the edges of the flange portions. In such location, the maximum torsional stiffness is obtained because the largest closed section is provided. However, such location is also preferred because the clamping of the two layers of metal provided by the reverse bends of the hems 18 is at a maximum at such locations and the bands of adhesive 22 and 23 can be made very thin.

Although the preferred embodiments of this invention have been shown and described, it should be understood that various modifications and rearrangements of the parts may be resorted to without departing from the scope of the invention as disclosed and claimed herein.

What is claimed is:

1. A grid tee for suspension ceilings and the like comprising a first elongated piece of sheet metal and bent to provide a stiffening bulb along one edge, a pair of parallel web portions extending from said bulb in face-to-face adjacency, and flange portions extending laterally in opposite directions from the side of said web remote from said bulb, and a second elongated piece of sheet metal forming a cap positioned in face-to-face adjacency with the side of said flange portions remote from said bulb and connected to said flange portions along their edges by a reverse bend extending around adjacent edges of said flange portions, and bands of cross-linking cured adhesive along the interface between said flange portions and said cap bonding said flange portions to said cap, said adhesive having sufficient shear strength and sufficient elasticity to permit said grid tee to twist through at least two degrees per inch of length without failure of said bond, and being substantially insensitive to temperatures normally encountered by said grid tee during shipment, storage, and use, said reverse bends operating to press said flange portions and said cap together along said interface where said bands of adhesive are located while said adhesive becomes cross-linked, said coating being undamaged by said adhesive.

2. A grid tee as set forth in claim 1, wherein said adhesive bands have a thickness less than about 0.006 inch and are at least about ⅛ inch wide.

3. A grid tee as set forth in claim 1, wherein said adhesive cross-links and cures after said grid tee is manufactured and while said grid tee is held in a straight condition.

4. A grid tee as set forth in claim 1, wherein said adhesive continues to provide a bond even when said grid tee is twisted an amount sufficient to cause the metal thereof to yield beyond its elastic limit.

5. A grid tee as set forth in claim 1, wherein said grid tee has sufficient torsional stiffness to require at least about 5 in./lbs. of torque to twist said grid tee through two degrees per inch of length.

6. A grid tee as set forth in claim 1, wherein said adhesive is located along two laterally spaced bands having a maximum average thickness less than about 0.006 inch.

7. A grid tee as set forth in claim 6, wherein said bands have an average thickness of about 0.003 inch.

8. A grid tee as set forth in claim 7, wherein said bands are located substantially adjacent to the outer edges of said flange portions and adjacent to said reverse bends.

9. A grid tee as set forth in claim 8, wherein said adhesive is a one-part solvent-free urethane-type adhesive which is activated to crosslink and cure by moisture.

10. A grid tee as set forth in claim 8, wherein said adhesive is an adhesive consisting of a methacrylate solid binder activated by an aldehyde catalyst.

* * * * *